US009803897B2

(12) United States Patent
Furui et al.

(10) Patent No.: US 9,803,897 B2
(45) Date of Patent: Oct. 31, 2017

(54) REFRIGERATION APPARATUS WHICH INJECTS AN INTERMEDIATE-GAS LIQUID REFRIGERANT FROM MULTI-STAGE EXPANSION CYCLE INTO THE COMPRESSOR

(75) Inventors: Shuji Furui, Osaka (JP); Kazuhiro Furusho, Osaka (JP); Hiroshi Yoh, Osaka (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 771 days.

(21) Appl. No.: 14/240,983

(22) PCT Filed: Aug. 29, 2012

(86) PCT No.: PCT/JP2012/005455

§ 371 (c)(1),
(2), (4) Date: Feb. 25, 2014

(87) PCT Pub. No.: WO2013/031218

PCT Pub. Date: Mar. 7, 2013

(65) Prior Publication Data

US 2014/0208787 A1 Jul. 31, 2014

(30) Foreign Application Priority Data

Sep. 1, 2011 (JP) ..... 2011-190430

(51) Int. Cl.
*F25B 41/04* (2006.01)
*F25B 30/02* (2006.01)
(Continued)

(52) U.S. Cl.
CPC ..... *F25B 30/02* (2013.01); *F25B 1/10* (2013.01); *F25B 40/00* (2013.01);
(Continued)

(58) Field of Classification Search
CPC .. F25B 1/10; F25B 30/02; F25B 40/00; F25B 2341/0662; F25B 2400/13; F25B 2400/23;
(Continued)

(56) References Cited

U.S. PATENT DOCUMENTS 5,056,329 A * 10/1991 Wilkinson ..... F25B 1/10 62/197
5,157,933 A * 10/1992 Brendel ..... F25B 1/10 62/196.4
(Continued)

FOREIGN PATENT DOCUMENTS

JP 57-179066 U 11/1982
JP 10-148404 A 6/1998
(Continued)

OTHER PUBLICATIONS

International Search Report issued in PCT/JP2012/005455, dated Oct. 9, 2012.
(Continued)

*Primary Examiner* — Ljiljana Ciric
(74) *Attorney, Agent, or Firm* — Birch, Stewart, Kolasch & Birch, LLP

(57) ABSTRACT

An air conditioning system includes a refrigerant circuit including a compressor, an indoor heat exchanger, a first expansion valve, a gas-liquid separator, a second expansion valve, and an outdoor heat exchanger which are sequentially connected together to perform a two-stage expansion refrigeration cycle. The refrigerant circuit further includes: a gas injection pipe through which intermediate-pressure gas refrigerant in the gas-liquid separator flows into an intermediate port of the compressor, and a liquid-gas heat exchanger configured to exchange heat between low-pressure gas refrigerant obtained by evaporating refrigerant in the outdoor heat exchanger and travelling toward the compressor
(Continued)

and intermediate-pressure liquid refrigerant travelling from the gas-liquid separator toward the second expansion valve.

3 Claims, 7 Drawing Sheets

(51) Int. Cl.
*F25B 40/00* (2006.01)
*F25B 1/10* (2006.01)

(52) U.S. Cl.
CPC ... *F25B 2341/0662* (2013.01); *F25B 2400/13* (2013.01); *F25B 2400/23* (2013.01); *F25B 2600/21* (2013.01); *F25B 2600/2513* (2013.01); *F25B 2700/1933* (2013.01); *F25B 2700/2103* (2013.01); *F25B 2700/21175* (2013.01)

(58) Field of Classification Search
CPC ..... F25B 2600/21; F25B 2600/2513; F25B 2700/1933; F25B 2700/2103; F25B 2700/21175
See application file for complete search history.

(56) References Cited

U.S. PATENT DOCUMENTS 5,582,022 A * 12/1996 Heinrichs ..... F25B 1/10 62/175
5,848,537 A * 12/1998 Biancardi ..... F04C 29/0007 62/324.6
6,044,655 A * 4/2000 Ozaki ..... F25B 9/008 62/205
6,347,528 B1 * 2/2002 Iritani ..... B60H 1/00357 62/323.1
6,581,397 B1 * 6/2003 Taira ..... F25B 9/002 62/199
9,494,347 B2 * 11/2016 Kayano ..... F25B 1/06
9,523,520 B2 * 12/2016 Takenaka ..... F25B 9/006
9,551,512 B2 * 1/2017 Ko ..... F25B 1/10
2006/0266074 A1 * 11/2006 Groll ..... F25B 1/10 62/510
2008/0060365 A1 * 3/2008 Sakitani ..... F25B 9/008 62/114
2008/0078192 A1 * 4/2008 Ignatiev ..... F25B 1/10 62/184
2008/0078204 A1 * 4/2008 Ignatiev ..... F25B 31/002 62/512
2008/0236179 A1 * 10/2008 Ignatiev ..... F25B 1/10 62/190
2008/0236184 A1 * 10/2008 Morozumi ..... F04C 18/3442 62/324.6
2009/0260380 A1 * 10/2009 Okamoto ..... F25B 1/10 62/204
2009/0282848 A1 * 11/2009 Takegami ..... F25B 13/00 62/222
2010/0175400 A1 * 7/2010 Kasahara ..... F25B 1/10 62/225
2010/0212342 A1 * 8/2010 Jeong ..... F25B 41/00 62/208
2010/0251761 A1 * 10/2010 Yoshimi ..... F25B 1/10 62/524
2011/0005270 A1 * 1/2011 Yoshimi ..... F25B 1/10 62/510
2011/0023535 A1 2/2011 Morimoto et al.
2011/0036110 A1 * 2/2011 Fujimoto ..... F24D 3/18 62/149
2011/0036119 A1 * 2/2011 Fujimoto ..... F25B 1/10 62/510
2011/0048055 A1 * 3/2011 Fujimoto ..... F25B 1/10 62/324.6
2011/0061413 A1 * 3/2011 Setoguchi ..... F24F 3/065 62/238.7
2011/0079042 A1 * 4/2011 Yamashita ..... C09K 5/045 62/498
2011/0113804 A1 * 5/2011 Chin ..... F25B 1/04 62/222
2011/0113808 A1 * 5/2011 Ko ..... F25B 1/04 62/324.3
2011/0203299 A1 * 8/2011 Jing ..... F25B 13/00 62/80
2013/0283843 A1 * 10/2013 Takenaka ..... F25B 9/006 62/324.6
2014/0318170 A1 * 10/2014 Katoh ..... F28F 9/26 62/324.5
2015/0052927 A1 * 2/2015 Yang ..... F25B 1/10 62/238.7
2015/0096321 A1 * 4/2015 Kawano ..... F25B 1/10 62/197
2015/0143841 A1 * 5/2015 Kawano ..... F25B 13/00 62/498
2015/0338121 A1 * 11/2015 Yamashita ..... F24F 11/008 62/196.1
2016/0280041 A1 * 9/2016 Suzuki ..... B60H 1/00921

FOREIGN PATENT DOCUMENTS

JP 11-142007 A 5/1999
JP 2007-178042 A 7/2007
JP 2009-222329 A 10/2009
JP 2010-101552 A 5/2010

OTHER PUBLICATIONS

Written Opinion of the International Searching Authority issued in PCT/JP2012/005455, dated Oct. 9, 2012.

* cited by examiner

| CAPACITY W | ··· | ··· | ① ★★ | ··· |
|---|---|---|---|---|
| TARGET DEGREE OF SUPERHEAT | ○○ | ○○ | ② ●● | ○○ |

| CAPACITY W | ··· | ··· | ⇦ ★★ ⇨ | ··· |
|---|---|---|---|---|
| DEGREE OF SUPERHEAT | TEMPORARY INTERMEDIATE PRESSURE Pm1 | | | |
| ○○ | ## | ## | ## | ## |
| ○○ | ## | ## | ## | ## |
| ●● | ## | ## | ③ ## | ## |
| ○○ | ## | ## | ## | ## |

REFRIGERATION APPARATUS WHICH INJECTS AN INTERMEDIATE-GAS LIQUID REFRIGERANT FROM MULTI-STAGE EXPANSION CYCLE INTO THE COMPRESSOR

TECHNICAL FIELD

The present invention relates to refrigeration apparatuses, and more particularly to a measure to increase the coefficient of performance (COP) and space heating capacity.

BACKGROUND ART

A refrigeration apparatus including a refrigerant circuit in which intermediate-pressure gas refrigerant is injected into a compressor has been conventionally known, and is described in, for example, PATENT DOCUMENT 1. Specifically, the refrigerant circuit of the refrigeration apparatus includes a compressor, a heat-source-side heat exchanger, a first expansion valve, a gas-liquid separator, a second expansion valve, and a utilization-side heat exchanger sequentially connected together, and performs a two-stage expansion refrigeration cycle. The refrigerant circuit includes an injection pipe through which intermediate-pressure gas refrigerant in the gas-liquid separator is injected into the compressor. In the refrigeration apparatus, intermediate-pressure gas refrigerant is injected into the compressor to increase the amount of refrigerant circulating through the utilization-side heat exchanger during heating operation, thereby increasing the space heating capacity. This increases the coefficient of performance (COP) during heating operation, and enables energy efficient heating operation.

CITATION LIST

Patent Document

PATENT DOCUMENT 1: Japanese Unexamined Patent Publication No. 2009-222329

SUMMARY OF THE INVENTION

Technical Problem

Incidentally, in areas where the outdoor air temperature is low, such as cold climate areas, there has been a demand for a refrigeration apparatus that performs energy efficient heating operation with increasing space heating capacity. To satisfy the demand, the above-described refrigeration apparatus of PATENT DOCUMENT 1 (Japanese Unexamined Patent Publication No. 2009-222329) may include a liquid-gas heat exchanger configured to increase the degree of superheat of refrigerant sucked into the compressor. The liquid-gas heat exchanger exchanges heat between low-pressure gas refrigerant obtained by evaporating refrigerant in the heat-source-side heat exchanger and high-pressure liquid refrigerant obtained by condensing refrigerant in the utilization-side heat exchanger. The liquid-gas heat exchanger superheats the low-pressure gas refrigerant to increase the degree of superheat of the refrigerant sucked into the compressor. With increasing degree of superheat of the sucked refrigerant, the temperature of refrigerant discharged from the compressor increases. This increases the enthalpy of refrigerant in the utilization-side heat exchanger to increase the space heating capacity (heating capacity) of the utilization-side heat exchanger.

However, when the refrigeration apparatus of PATENT DOCUMENT 1 (Japanese Unexamined Patent Publication No. 2009-222329) merely includes a liquid-gas heat exchanger, the effect of increasing the coefficient of performance (COP) by injecting intermediate-pressure gas refrigerant into the compressor is reduced. This problem will be specifically described with reference to FIGS. 11A and 11B.

In the compressor, low-pressure gas refrigerant (the point a in each of FIGS. 11A and 11B) is compressed to high pressure, and the compressed gas refrigerant is discharged (the point b in each of FIGS. 11A and 11B). The high-pressure refrigerant discharged from the compressor exchanges heat with indoor air in the utilization-side heat exchanger, and is condensed (the point c in each of FIGS. 11A and 11B). Thus, the indoor air is heated to heat a room. The high-pressure liquid refrigerant obtained by condensing the high-pressure refrigerant in the utilization-side heat exchanger exchanges heat with low-pressure gas refrigerant in the liquid-gas heat exchanger, and is subcooled (the point d in each of FIGS. 11A and 11B). The subcooled high-pressure liquid refrigerant is depressurized through the first expansion valve to form intermediate-pressure refrigerant (the point e in each of FIGS. 11A and 11B). The intermediate-pressure refrigerant obtained by depressurizing the high-pressure liquid refrigerant through the first expansion valve flows into the gas-liquid separator, and is separated into a liquid refrigerant component and a gas refrigerant component. The intermediate-pressure liquid refrigerant component separated by the gas-liquid separator (the point f in each of FIGS. 11A and 11B) is depressurized through the second expansion valve to form low-pressure refrigerant (the point g in each of FIGS. 11A and 11B). In contrast, the intermediate-pressure gas refrigerant component separated by the gas-liquid separator is injected through the injection pipe into the compressor (the point i in each of FIGS. 11A and 11B). The low-pressure refrigerant obtained by depressurizing the intermediate-pressure liquid refrigerant component through the second expansion valve evaporates in the heat-source-side heat exchanger to form low-pressure gas refrigerant (the point h in each of FIGS. 11A and 11B). The low-pressure gas refrigerant exchanges heat with high-pressure liquid refrigerant in the liquid-gas heat exchanger, is superheated, and is sucked into the compressor (the point a in each of FIGS. 11A and 11B).

Through the above-described flow of refrigerant, when the high-pressure liquid refrigerant that has flowed out of the utilization-side heat exchanger is subcooled by the liquid-gas heat exchanger, this subcooling decreases the proportion of gas refrigerant in the intermediate-pressure refrigerant that is obtained by depressurizing the subcooled high-pressure liquid refrigerant through the first expansion valve and flows into the gas-liquid separator as illustrated in FIG. 11A. This decreases the amount of gas refrigerant injected into the compressor (injection amount). To address such a decrease, the intermediate pressure (the pressure at the points e, f, and i in FIG. 11B) may be decreased to increase the proportion of gas refrigerant in the intermediate-pressure refrigerant that flows into the gas-liquid separator as illustrated in FIG. 11B. However, in this case, the difference between the intermediate pressure and the low pressure (the pressure difference between the points f and g in FIG. 11B) decreases. This makes it difficult for gas refrigerant to flow through the gas-liquid separator into the compressor. For this reason, also in this case, the amount of gas refrigerant injected into the compressor (injection amount) decreases. Since, as such, the injection amount through the gas-liquid separator into the compressor decreases, the coefficient of performance (COP) cannot be adequately increased. As a result, energy efficient heating operation cannot be performed.

It is therefore an object of the present invention to provide a refrigeration apparatus including a refrigerant circuit in which gas is injected through an intermediate-pressure gas-liquid separator into a compressor, and enabling energy efficient heating operation with increasing space heating capacity.

Solution to the Problem

A first aspect of the invention is directed to a refrigeration apparatus including: a refrigerant circuit (20) including a compression mechanism (21), a utilization-side heat exchanger (22), a first expansion valve (23), a gas-liquid separator (24), a second expansion valve (26), and a heat-source-side heat exchanger (27) which are sequentially connected together to perform a two-stage expansion refrigeration cycle. The refrigerant circuit (20) further includes: a gas injection pipe (2*c*) through which gas refrigerant in the gas-liquid separator (24) flows into a portion of the compression mechanism (21) in which refrigerant is being compressed, and a liquid-gas heat exchanger (25) configured to exchange heat between gas refrigerant obtained by evaporating refrigerant in the heat-source-side heat exchanger (27) and travelling toward the compression mechanism (21) and liquid refrigerant travelling from the gas-liquid separator (24) toward the second expansion valve (26).

In the first aspect of the invention, when refrigerant circulates in a heating cycle, the utilization-side heat exchanger (22) functions as a condenser (radiator), and the heat-source-side heat exchanger (27) functions as an evaporator. In this case, high-pressure liquid refrigerant obtained by condensing the refrigerant in the utilization-side heat exchanger (22) is depressurized through the first expansion valve (23) to form intermediate-pressure refrigerant, and the gas-liquid separator (24) separates the intermediate-pressure refrigerant into an intermediate-pressure liquid refrigerant component and an intermediate-pressure gas refrigerant component. The resultant intermediate-pressure liquid refrigerant component flows into the liquid-gas heat exchanger (25). Furthermore, low-pressure gas refrigerant obtained by evaporating the refrigerant in the heat-source-side heat exchanger (27) exchanges heat with the intermediate-pressure liquid refrigerant component in the liquid-gas heat exchanger (25), and is superheated, and the superheated gas refrigerant is then sucked into the compressor (21).

According to a second aspect of the invention, the refrigeration apparatus of the first aspect of the invention may further include: an intermediate pressure setter (41) configured to determine an intermediate pressure value of the two-stage expansion refrigeration cycle such that a liquid-to-gas temperature difference between liquid refrigerant and gas refrigerant in the liquid-gas heat exchanger (25) is greater than or equal to a required liquid-to-gas temperature difference therebetween determined based on a required degree of superheat of refrigerant sucked into the compression mechanism (21), where the required degree of superheat corresponds to required heating capacity of the utilization-side heat exchanger (22), and such that an amount of gas refrigerant through the gas injection pipe (2*c*) is greatest; and a valve controller (45) configured to control at least one of the first or second expansion valve (23) or (26) such that an intermediate pressure of the two-stage expansion refrigeration cycle is equal to the intermediate pressure value determined by the intermediate pressure setter (41).

In the second aspect of the invention, the degree of superheat of the refrigerant sucked into the compression mechanism (21) is set at a value required to satisfy the required heating capacity (required space heating capacity) of the utilization-side heat exchanger (22). Then, the intermediate pressure value of the refrigeration cycle is determined such that the difference in temperature between intermediate-pressure liquid refrigerant and low-pressure gas refrigerant in the liquid-gas heat exchanger (25) (liquid-to-gas temperature difference) is greater than or equal to the temperature difference required to satisfy the required degree of superheat (required liquid-to-gas temperature difference), and such that the amount of intermediate-pressure gas refrigerant flowing through the gas-liquid separator (24) into the compressor (21) (gas injection amount) is greatest. The degree of opening of the first and/or second expansion valve (23) and/or (26) is adjusted such that the actual intermediate pressure of the refrigeration cycle is equal to the determined intermediate pressure value.

According to a third aspect of the invention, in the second aspect of the invention, the intermediate pressure setter (41) may includes: a temporary value setter (42) configured to determine a temporary intermediate pressure value of the two-stage expansion refrigeration cycle under which a coefficient of performance of the refrigeration cycle is greatest, based on the required degree of superheat of the refrigerant sucked into the compression mechanism (21); and a determiner (43) configured to calculate a required amount of heat to be exchanged between liquid refrigerant and gas refrigerant in the liquid-gas heat exchanger (25) based on a temperature of the gas refrigerant at an inlet of the liquid-gas heat exchanger (25) and a temperature of the gas refrigerant at an outlet of the liquid-gas heat exchanger (25) when, after the temporary value setter (42) has determined the temporary intermediate pressure value, a degree of superheat of the refrigerant sucked into the compression mechanism (21) reaches the required degree of superheat, calculate a required liquid-to-gas temperature difference between the liquid refrigerant and the gas refrigerant in the liquid-gas heat exchanger (25) based on the required amount of heat to be exchanged, select the temporary intermediate pressure value determined by the temporary value setter (42) as the intermediate pressure value of the two-stage expansion refrigeration cycle in a situation where an actual liquid-to-gas temperature difference between the liquid refrigerant and the gas refrigerant in the liquid-gas heat exchanger (25) is greater than the required liquid-to-gas temperature difference, and select the intermediate pressure value previously determined based on the required liquid-to-gas temperature difference as the intermediate pressure value of the two-stage expansion refrigeration cycle in a situation where the actual liquid-to-gas temperature difference is less than or equal to the required liquid-to-gas temperature difference. When the temporary value setter (42) determines the temporary intermediate pressure value, the valve controller (45) may control at least one of the first or second expansion valve (23) or (26) such that the intermediate pressure of the two-stage expansion refrigeration cycle is equal to the determined temporary intermediate pressure value, and when the determiner (43) determines the intermediate pressure value, the valve controller (45) may control at least one of the first or second expansion valve (23) or (26) such that the intermediate pressure of the two-stage expansion refrigeration cycle is equal to the determined intermediate pressure value.

In the third aspect of the invention, the temporary intermediate pressure value is set at a value that allows the coefficient of performance to be greatest, based on the required degree of superheat. When the temporary intermediate pressure value is determined, the degree of opening of the first and/or second expansion valve (23) and/or (26) is adjusted such that the actual intermediate pressure is equal to the determined temporary intermediate pressure value. Then, when the degree of superheat of the refrigerant sucked into the compressor (21) reaches the required degree of superheat, the required amount of heat to be exchanged between liquid refrigerant and gas refrigerant in the liquid-gas heat exchanger (25) is calculated based on the difference between the temperature of gas refrigerant at the inlet of the liquid-gas heat exchanger (25) and the temperature of gas refrigerant at the outlet thereof. Subsequently, the required liquid-to-gas temperature difference in the liquid-gas heat exchanger (25) for satisfying the required amount of heat to be exchanged is calculated. When the actual liquid-to-gas temperature difference is greater than the required liquid-to-gas temperature difference, the intermediate pressure value is set at the above-described determined temporary intermediate pressure value. When the actual liquid-to-gas temperature difference is less than or equal to the required liquid-to-gas temperature difference, the intermediate pressure value is set at a value corresponding to the required liquid-to-gas temperature difference.

Advantages of the Invention

As described above, the refrigeration apparatus of the present invention includes: a gas injection pipe (2*c*) through which intermediate-pressure gas refrigerant in the gas-liquid separator (24) flows into a portion of the compression mechanism (21) in which refrigerant is being compressed, and a liquid-gas heat exchanger (25) configured to exchange heat between low-pressure gas refrigerant obtained by evaporating refrigerant in the heat-source-side heat exchanger (27) and travelling toward the compression mechanism (21) and intermediate-pressure liquid refrigerant travelling from the gas-liquid separator (24) toward the second expansion valve (26). The above configuration enables the injection of a sufficient amount of gas refrigerant into the compressor (21), and can ensure a sufficient degree of superheat of refrigerant sucked into the compressor (21). This can adequately increase both of the coefficient of performance (COP) of the refrigeration cycle and space heating capacity. This increase enables energy efficient heating operation satisfying the required space heating capacity.

According to the refrigeration apparatus of the second aspect of the invention, the intermediate pressure value is determined such that the actual liquid-to-gas temperature difference is greater than or equal to the required liquid-to-gas temperature difference for allowing the degree of superheat of the refrigerant sucked into the compressor (21) to satisfy the required degree of superheat, and such that the amount of gas refrigerant injected through the gas injection pipe (2*c*) allows the coefficient of performance of the refrigeration cycle to be optimum. This enables the determination of the intermediate pressure value which satisfies the required space heating capacity and under which the coefficient of performance of the refrigeration cycle is optimum. This determination enables energy efficient heating operation satisfying the required capacity.

BRIEF DESCRIPTION OF THE DRAWINGS

FIG. 11B illustrates a state in which the intermediate pressure is lower than that in FIG. 11A.

DESCRIPTION OF EMBODIMENTS

An embodiment of the present invention will be described in detail hereinafter with reference to the drawings. The following embodiment is merely a preferred example in nature, and is not intended to limit the scope, applications, and use of the disclosure.

Figure 1:
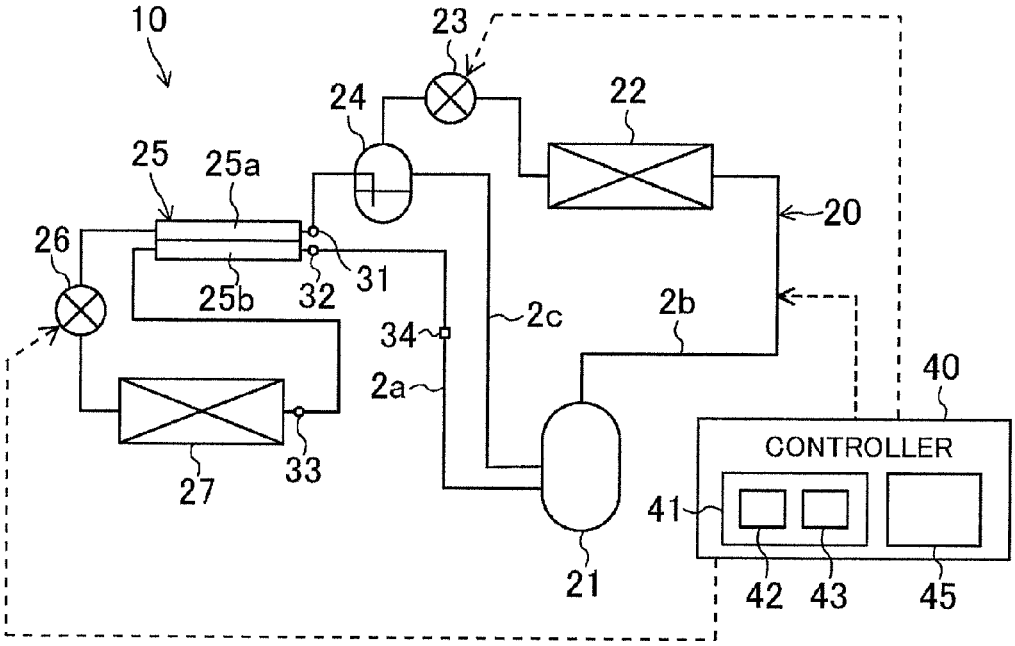
FIG. 1 is a refrigerant circuit diagram of an air conditioning system according to an embodiment.

As illustrated in FIG. 1, an air conditioning system (10) of this embodiment performs heating operation, and forms a refrigeration apparatus according to the present invention.

The air conditioning system (10) includes a refrigerant circuit (20) through which refrigerant circulates to perform a two-stage expansion refrigeration cycle. The refrigerant circuit (20) includes a compressor (21) serving as a compression mechanism for refrigerant, an indoor heat exchanger (22) serving as a utilization-side heat exchanger, a first expansion valve (23), a gas-liquid separator (24), a liquid-gas heat exchanger (25), a second expansion valve (26), and an outdoor heat exchanger (27) serving as a heat-source-side heat exchanger. The compressor (21), the indoor heat exchanger (22), the first expansion valve (23), the gas-liquid separator (24), the liquid-gas heat exchanger (25), the second expansion valve (26), and the outdoor heat exchanger (27) are sequentially connected through pipes. The refrigerant circuit (20) forms a closed circuit.

The compressor (21) has a compression chamber (not shown) into which refrigerant is sucked and in which the refrigerant is compressed, and is, for example, a scroll rotary compressor or a rolling piston rotary compressor. A discharge side of the compressor (21) is connected to a gas-side end of the indoor heat exchanger (22) through a discharge-side pipe (2*b*). A liquid-side end of the indoor heat exchanger (22) is connected to the gas-liquid separator (24) through the first expansion valve (23).

The liquid-gas heat exchanger (25) has a liquid-side channel (25*a*) and a gas-side channel (25*b*). One end of the liquid-side channel (25*a*) of the liquid-gas heat exchanger (25) is connected to the gas-liquid separator (24), and the other end thereof is connected to a liquid-side end of the outdoor heat exchanger (27) through the second expansion valve (26). One end of the gas-side channel (25*b*) of the liquid-gas heat exchanger (25) is connected to a gas-side end of the outdoor heat exchanger (27), and the other end thereof is connected to a suction side of the compressor (21) through a suction-side pipe (2*a*).

The indoor heat exchanger (22) and the outdoor heat exchanger (27) are air heat exchangers configured to exchange heat between refrigerant and delivered air. The liquid-gas heat exchanger (25) exchanges heat between liquid refrigerant flowing through the liquid-side channel (25*a*) and gas refrigerant flowing through the gas-side channel (25*b*). Specifically, the liquid-gas heat exchanger (25) is configured to exchange heat between gas refrigerant that is obtained by evaporating refrigerant in the outdoor heat exchanger (27) and travels toward the compressor (21) and liquid refrigerant that travels through the gas-liquid separator (24) toward the second expansion valve (26). The first and second expansion valves (23) and (26) are motor-operated valves each having an adjustable degree of opening.

The gas-liquid separator (24) separates refrigerant that has flowed thereinto through the first expansion valve (23) into a liquid refrigerant component and a gas refrigerant component. A gas injection pipe (2*c*) is connected between the gas-liquid separator (24) and the compressor (21). Specifically, an inlet end of the gas injection pipe (2*c*) communicates with a gas layer of the gas-liquid separator (24), and an outlet end thereof is connected to an intermediate port (not shown) of the compressor (21). The intermediate port of the compressor (21) communicates with the compression chamber in which refrigerant is being compressed. In other words, the gas refrigerant component in the gas-liquid separator (24) flows through the gas injection pipe (2*c*) into a portion of the compressor (21) in which refrigerant is being compressed.

The refrigerant circuit (20) includes various sensors. Specifically, a pipe near an inlet of the liquid-side channel (25*a*) of the liquid-gas heat exchanger (25) includes a first temperature sensor (31), and a pipe near an outlet of the gas-side channel (25*b*) (i.e., the suction-side pipe (2*a*)) includes a second temperature sensor (32). A pipe near an outlet of the outdoor heat exchanger (27) includes a third temperature sensor (33). The suction-side pipe (2*a*) further includes a pressure sensor (34). The first through third temperature sensors (31-33) sense the refrigerant temperature, and the pressure sensor (34) senses the refrigerant pressure.

The air conditioning system (10) includes a controller (40). The controller (40) controls the capacity of the compressor (21), and includes an intermediate pressure setter (41) and a valve controller (45). The intermediate pressure setter (41) is configured to determine the intermediate pressure value of a refrigeration cycle based on the required space heating capacity. The intermediate pressure setter (41) includes a temporary value setter (42) and a determiner (43). The valve controller (45) is configured to control the degree of opening of at least one of the first or second expansion valve (23) or (26) such that the intermediate pressure of the refrigeration cycle is equal to the value determined by the intermediate pressure setter (41). Determination operation of the intermediate pressure setter (41) will be described in detail below.

The refrigerant circuit (20) of this embodiment is filled with single component refrigerant containing HFO-1234yf (2,3,3,3-tetrafluoro-1-propene) as refrigerant. Note that a chemical formula of the HFO-1234yf is represented by an expression $CF_3—CF{=}CH_2$. That is, such refrigerant is a type of single component refrigerant containing refrigerant represented by a molecular formula of $C_3H_mF_n$ (where "m" and "n" are integers equal to or greater than 1 and equal to or less than 5, and a relationship represented by an expression m+n=6 is satisfied) and having a single double bond in a molecular structure.

—Operational Behavior—

Next, the behavior of the above-described air conditioning system (10) during heating operation will be described with reference to FIGS. 1 and 2.

Figure 2:
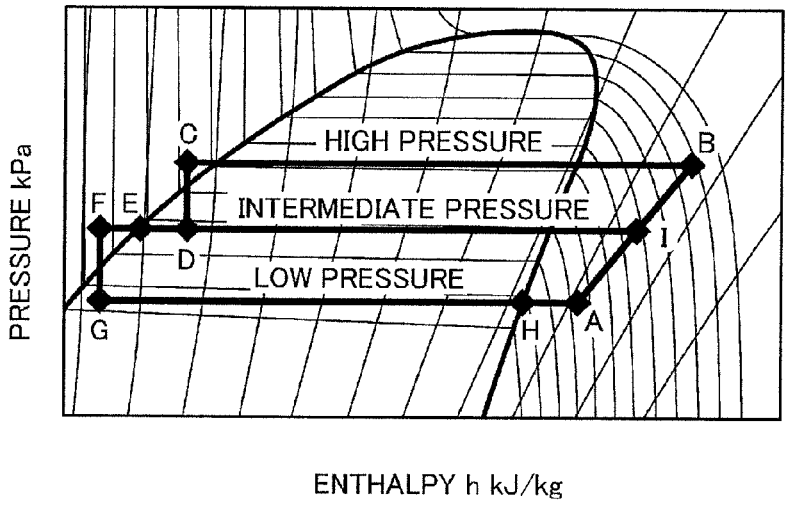
FIG. 2 is a Mollier diagram illustrating the behavior of refrigerant in a refrigerant circuit during heating operation according to the embodiment.

In the compressor (21), low-pressure gas refrigerant (the point A in FIG. 2) that has flowed thereinto through the suction-side pipe (2*a*) is compressed to high pressure, and the compressed refrigerant is discharged (the point B in FIG. 2). The high-pressure refrigerant discharged from the compressor (21) exchanges heat with indoor air in the indoor heat exchanger (22), and is condensed (the point C in FIG. 2). Thus, the indoor air is heated to heat a room.

The high-pressure refrigerant condensed in the indoor heat exchanger (22) is depressurized through the first expansion valve (23) to form intermediate-pressure refrigerant (the point D in FIG. 2). The intermediate-pressure refrigerant obtained by depressurizing the high-pressure refrigerant through the first expansion valve (23) flows into the gas-liquid separator (24), and is separated into a liquid refrigerant component and a gas refrigerant component. The intermediate-pressure liquid refrigerant component separated by the gas-liquid separator (24) flows into the liquid-side channel (25*a*) of the liquid-gas heat exchanger (25) (the point E in FIG. 2), and the gas refrigerant component separated by the gas-liquid separator (24) flows into the intermediate port of the compressor (21) through the gas injection pipe (2*c*) (the point I in FIG. 2).

In the liquid-gas heat exchanger (25), the intermediate-pressure liquid refrigerant component that has flowed into the liquid-side channel (25*a*) exchanges heat with low-pressure gas refrigerant flowing through the gas-side channel (25*b*), and is subcooled (the point F in FIG. 2). The intermediate-pressure liquid refrigerant component that has been subcooled in the liquid-gas heat exchanger (25) is depressurized through the second expansion valve (26) to form low-pressure refrigerant (the point G in FIG. 2). The low-pressure refrigerant obtained by depressurizing the intermediate-pressure liquid refrigerant component through the second expansion valve (26) exchanges heat with outdoor air in the outdoor heat exchanger (27), and is evaporated to form low-pressure gas refrigerant (the point H in FIG. 2). The low-pressure gas refrigerant obtained by evaporating the low-pressure refrigerant in the outdoor heat exchanger (27) flows into the gas-side channel (25*b*) of the liquid-gas heat exchanger (25), and exchanges heat with the intermediate-pressure liquid refrigerant flowing through the liquid-side channel (25*a*) as described above. Thus, the low-pressure gas refrigerant at the point H in FIG. 2 is superheated to form refrigerant at the point A therein, and the refrigerant thereat is again sucked into the compressor (21). In other words, in the liquid-gas heat exchanger (25), the liquid refrigerant flowing through the liquid-side channel (25*a*) has a higher temperature than the gas refrigerant flowing through the gas-side channel (25*b*). While the refrigerant sucked into the compressor (21) is compressed such that its pressure is increased finally to high pressure (the point B in FIG. 2), the refrigerant is mixed with intermediate-pressure gas refrigerant that has flowed into the compressor (21) through the gas injection pipe (2*c*) in course of the compression (the point I in FIG. 2).

As described above, the high-pressure liquid refrigerant that has flowed out of the indoor heat exchanger (22) is depressurized through the first expansion valve (23), and then flows into the gas-liquid separator (24). This can ensure the adequate proportion of intermediate-pressure gas refrigerant in the gas-liquid separator (24) even in a situation where the intermediate pressure is not reduced so much. Furthermore, since the intermediate pressure does not need to be reduced so much, this can ensure the adequate difference between the intermediate pressure and the low pressure. Thus, a sufficient amount of gas refrigerant can be injected through the gas-liquid separator (24) into the compressor (21). This can increase the coefficient of performance (COP).

Since the low-pressure gas refrigerant that has flowed out of the outdoor heat exchanger (27) is superheated in the liquid-gas heat exchanger (25), this can increase the degree of superheat SH of refrigerant sucked into the compressor (21). This increases the temperature of refrigerant discharged from the compressor (21), thereby increasing the enthalpy of refrigerant in the indoor heat exchanger (22). This increases the space heating capacity.

The above configuration enables heating operation with increasing space heating capacity at a high coefficient of performance. Thus, while the required space heating capacity is satisfied, energy efficient operation can be performed.

—Determination of Intermediate Pressure Value—

Next, operation in which the intermediate pressure setter (41) determines an intermediate pressure value Pm (hereinafter simply referred to also as a set value Pm) will be described with reference to FIGS. 3-10.

Figure 3:
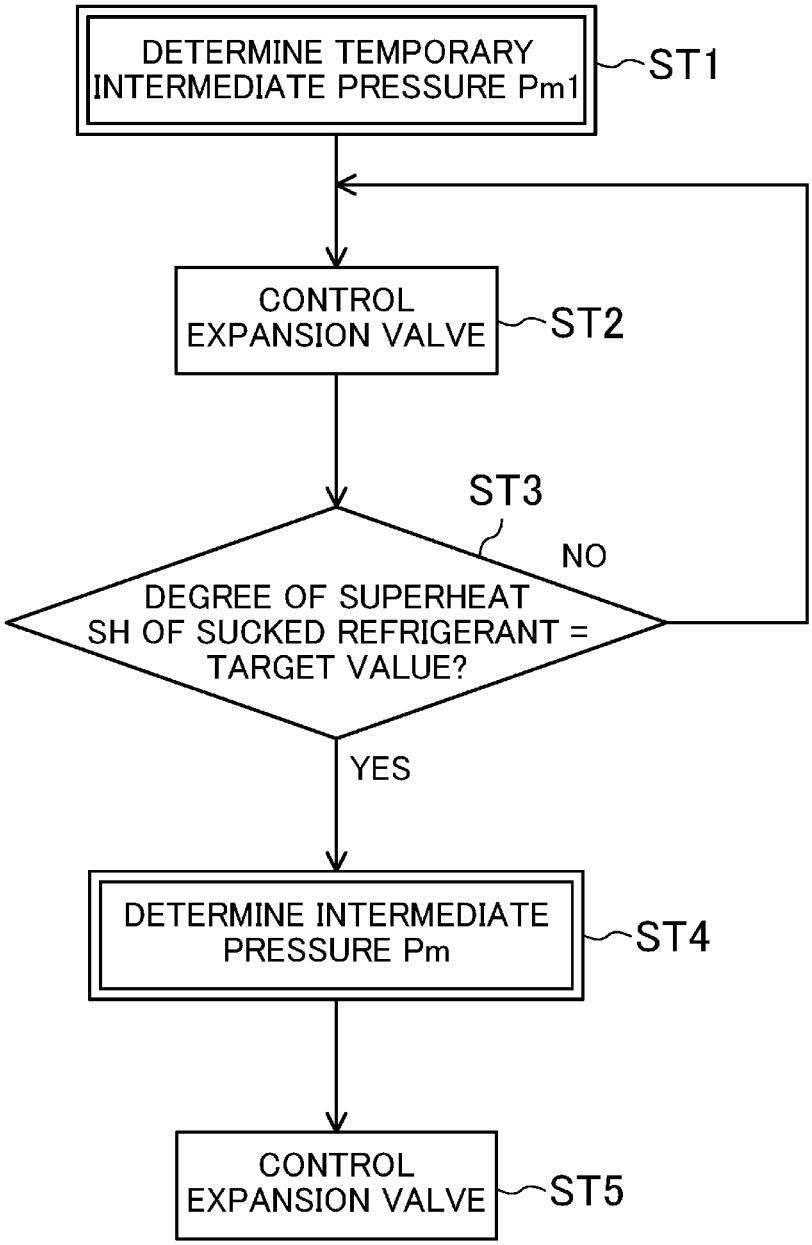
FIG. 3 is a flow chart illustrating control operation of a controller.

The intermediate pressure setter (41) determines the intermediate pressure value Pm in accordance with a flow chart illustrated in FIG. 3. Specifically, a temporary intermediate pressure value Pm1 is first determined in step ST1. Subsequently, the valve controller (45) controls the degree of opening of the first and/or second expansion valve (23) and/or (26) such that the intermediate pressure of the refrigeration cycle is equal to the temporary intermediate pressure value Pm1 (step ST2). Then, when, in the intermediate pressure setter (41), it is recognized that the degree of superheat SH has reached a target value (step ST3), the intermediate pressure value Pm is determined (step ST4). Subsequently, the valve controller (45) controls the degree of opening of the first and/or second expansion valve (23) and/or (26) such that the intermediate pressure of the refrigeration cycle is equal to the determined intermediate pressure value Pm (step ST5). Note that the intermediate pressure of the refrigeration cycle corresponds to the refrigerant pressure at the points D, E, F, and I illustrated in FIG. 2.

<Operation of Temporary Setter>

The temporary value setter (42) of the intermediate pressure setter (41) determines the temporary intermediate pressure value Pm1 as described above (step ST1). The temporary value setter (42) determines the temporary intermediate pressure value Pm1 in accordance with a flow chart illustrated in FIG. 4. The temporary intermediate pressure value Pm1 is a temporarily determined intermediate pressure value of the refrigeration cycle. First, the required space heating capacity is input to the temporary value setter (42) (step ST11). The required space heating capacity is the heating capacity required of the indoor heat exchanger (22).

Figures 4, 5:
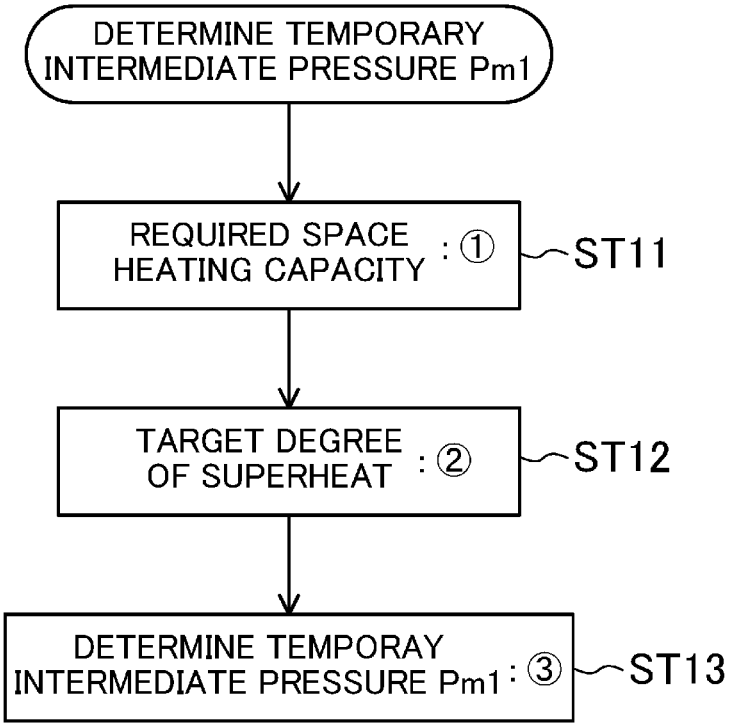
FIG. 4 is a flow chart illustrating determination operation for a temporary intermediate pressure value Pm1.
FIG. 5 is an example table of a temporary value setter.

Subsequently, the temporary value setter (42) determines the required degree of superheat SH corresponding to the required space heating capacity, based on such a table as illustrated in FIG. 5 (step ST12). Here, the required degree of superheat SH is the target degree of superheat SH of refrigerant sucked into the compressor (21) (i.e., refrigerant at the point A illustrated in FIG. 2). The space heating capacity varies depending on the degree of superheat SH of the refrigerant sucked into the compressor (21). For example, with increasing degree of superheat SH of the refrigerant sucked into the compressor (21), the temperature of refrigerant discharged from the compressor (21) (i.e., refrigerant at the point B illustrated in FIG. 2) increases, and the enthalpy of refrigerant flowing into the indoor heat exchanger (22) increases. This increases the space heating capacity (heating capacity) of the indoor heat exchanger (22). In the table illustrated in FIG. 5, the degree of superheat SH of the sucked refrigerant is set at a value required to satisfy the required space heating capacity. It should be noted that the stars (★★) in FIG. 5 are a placeholder for the particular value of the "required space heating capacity" determined in step ST11 of FIG. 4; the dots (●●) in FIG. 5 are a placeholder for the particular value of the "target degree of superheat" determined in step ST12 of FIG. 4, the circles (○○) in FIG. 5 are placeholder for other potential values of the "target degree of superheat"; and the hashtags (##) in FIG. 5 are the placeholder for potential values of the temporary intermediate pressure (Pm1) determined in step ST13 of FIG. 4.

Figures 6, 7:
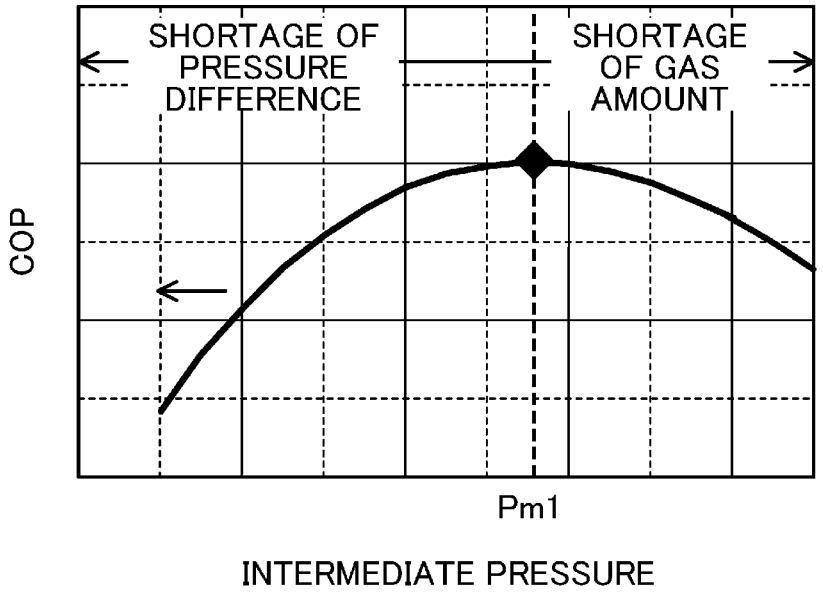
FIG. 6 is an example table of the temporary value setter.
FIG. 7 is a graph for explaining the intermediate pressure-to-COP relationship.
Figure 8:
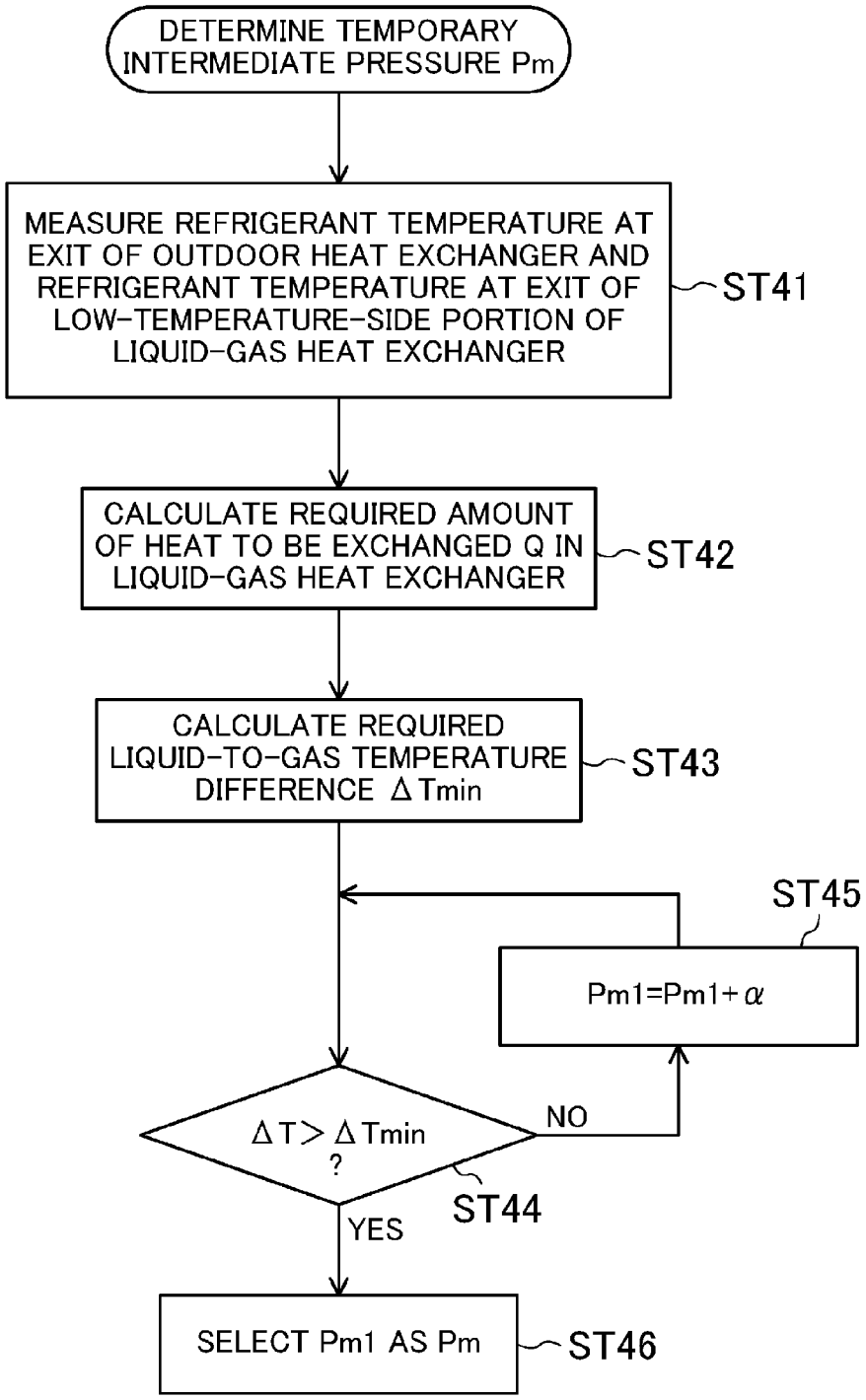
FIG. 8 is a flow chart illustrating determination operation for an intermediate pressure value Pm.

Subsequently, the temporary value setter (42) determines the temporary intermediate pressure value Pm1 which corresponds to the required degree of superheat SH and under which the coefficient of performance (COP) of the refrigeration cycle is greatest, based on such a table as illustrated in FIG. 6 (step ST13). The coefficient of performance (COP) of the refrigeration cycle herein is the space heating capacity (heating capacity) of the indoor heat exchanger (22) corresponding to the value input to the compressor (21), or the difference in enthalpy between the points B and C in FIG. 2 corresponding to the difference in enthalpy between the points A and B therein. In the table illustrated in FIG. 6, the intermediate pressure value under which the coefficient of performance (COP) of the refrigeration cycle is greatest is determined in accordance with the space heating capacity and the degree of superheat SH. It should be noted that FIG. 6 incorporates similar placeholders are FIG. 5. Specifically, the stars (★★) in FIG. 6 are placeholder for the particular value of the "required space heating capacity" determined in step ST11 of FIG. 4; the dots (●●) in FIG. 6 are a placeholder for the circles (○○) in FIG. 6 are placeholders for other potential values of the "target degree of superheat"; and the hashtags (##) in FIG. 6 are a placeholder for potential values of the temporary intermediate pressure (Pm1) determined in step ST13 of FIG. 4.

When, in the refrigerant circuit (20) of this embodiment, intermediate-pressure gas refrigerant in the gas-liquid separator (24) is injected into the compressor (21), the amount of refrigerant circulating through the indoor heat exchanger (22) increases by the amount of the intermediate-pressure gas refrigerant injected thereinto, and the space heating capacity of the indoor heat exchanger (22), therefore, increases. This increases the coefficient of performance of the refrigeration cycle (an injection effect). In other words, with increasing gas injection amount, the space heating capacity increases, and the coefficient of performance of the refrigeration cycle increases. Here, as illustrated in FIG. 7, with increasing intermediate pressure of the refrigeration cycle, the proportion of gas refrigerant in the gas-liquid separator (24) decreases, and the amount of gas refrigerant flowing through the gas injection pipe (2*c*) into the compressor (21) (the gas injection amount), therefore, decreases. With decreasing intermediate pressure of the refrigeration cycle, the proportion of gas refrigerant in the gas-liquid separator (24) increases while the difference between the intermediate pressure and the low pressure decreases. This reduces the gas injection amount. For this reason, if the intermediate pressure is set at a value under which the gas injection amount is largest, the coefficient of performance of the refrigeration cycle is greatest. In other words, in step ST13, as illustrated in FIG. 7, the temporary intermediate pressure value Pm1 is set at a value under which the coefficient of performance of the refrigeration cycle is greatest, i.e., a value under which the gas injection amount is largest. The tables illustrated in FIGS. 5 and 6 are previously stored in the temporary value setter (42).

The intermediate-pressure gas refrigerant in the gas-liquid separator (24) has a lower temperature than refrigerant that is being compressed in the compressor (21). Thus, the injection of the intermediate-pressure gas refrigerant into the compressor (21) decreases the temperature of refrigerant discharged from the compressor (21). This decreases both of the value input to the compressor (21) and the space heating capacity of the indoor heat exchanger (22). The rate of decrease of the value input to the compressor (21) is higher than that of the space heating capacity, and the coefficient of performance of the refrigeration cycle, therefore, increases.

When the temporary intermediate pressure value Pm1 is determined in the foregoing manner, the degree of opening of the first and/or second expansion valve (23) and/or (26) is controlled such that the intermediate pressure of the refrigeration cycle is equal to the determined temporary intermediate pressure value Pm1 as described above (step ST2). Then, the intermediate pressure setter (41) determines whether or not the degree of superheat SH of refrigerant sucked into the compressor (21) (the degree of superheat SH of the sucked refrigerant) has reached the required degree of superheat SH (step ST3). When the degree of superheat SH of the sucked refrigerant has reached the required degree of superheat SH, the process proceeds to determination operation for the intermediate pressure value Pm (step ST4). Note that the degree of superheat SH of the refrigerant sucked into the compressor (21) is a value obtained by subtracting the saturation temperature corresponding to the pressure sensed by the pressure sensor (34) from the temperature sensed by the second temperature sensor (32).

<Operation of Determiner>

The determiner (43) of the intermediate pressure setter (41) determines the intermediate pressure value Pm (step ST4). The determiner (43) determines the intermediate pressure value Pm in accordance with a flow chart illustrated in FIG. 8.

First, the third temperature sensor (33) and the second temperature sensor (32) respectively measure the refrigerant temperature at the outlet of the outdoor heat exchanger (27) and the refrigerant temperature at the outlet of a low-temperature-side portion of the liquid-gas heat exchanger (25), and the measured values are input to the determiner (43) (step ST41). The difference between the two outlet temperatures input to the determiner (43) determines the amount of heat exchanged in the liquid-gas heat exchanger (25) at this time. Note that the liquid-side channel (25*a*) of the liquid-gas heat exchanger (25) herein is referred to also as a high-temperature-side portion thereof, and the gas-side channel (25*b*) thereof is referred to also as a low-temperature-side portion thereof.

Subsequently, the determiner (43) calculates the shortage of space heating capacity based on the difference between the space heating capacity at this time and the required space heating capacity, and calculates the required amount of heat to be exchanged Q in the liquid-gas heat exchanger (25) (step ST42). The required amount of heat to be exchanged Q compensates for the shortage of space heating capacity. In other words, the required amount of heat to be exchanged Q is required to superheat gas refrigerant in the liquid-gas heat exchanger (25) to the required degree of superheat SH. For example, the temperature of refrigerant discharged from the compressor (21) is set at a value required to satisfy the required space heating capacity (target discharge temperature), and the degree of superheat SH is set at a value required to allow the temperature of the discharged refrigerant to reach the target discharge temperature (required degree of superheat SH).

Subsequently, the determiner (43) calculates the liquid refrigerant-to-gas refrigerant temperature difference required to allow the amount of heat exchanged in the liquid-gas heat exchanger (25) to be equal to the required amount of heat to be exchanged Q (hereinafter referred to as the required liquid-to-gas temperature difference ΔTmin) based on an expression described below (step ST43). In other words, the required liquid-to-gas temperature difference Δ Tmin is the liquid refrigerant-to-gas refrigerant temperature difference required to superheat gas refrigerant in the liquid-gas heat exchanger (25) to the required degree of superheat SH.

$$\Delta T\text{min}=Q/KA$$

where K represents the overall heat transfer coefficient of the liquid-gas heat exchanger (25) (heat exchanger performance), and A represents the heat transfer area of the liquid-gas heat exchanger (25).

Figure 9:
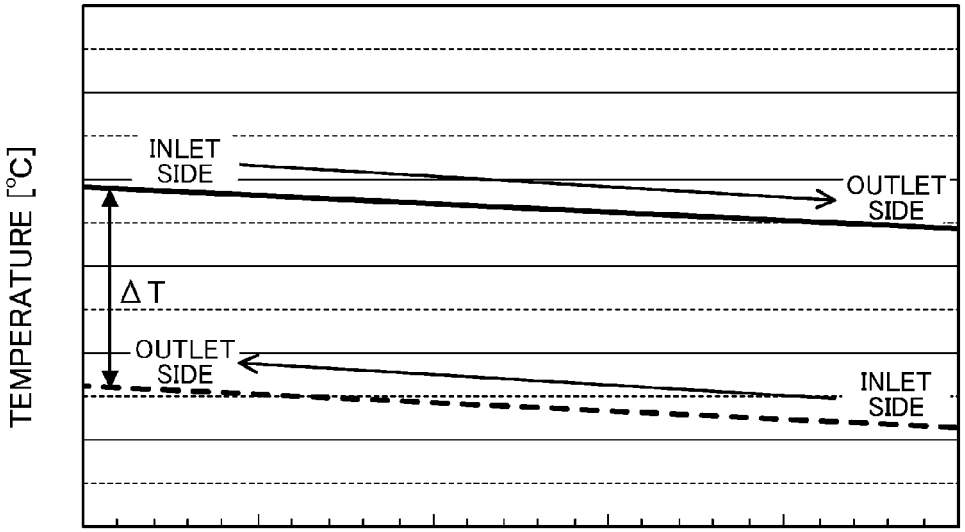
FIG. 9 is a graph for explaining the relationship between the temperature of liquid refrigerant in a liquid-gas heat exchanger and that of gas refrigerant therein.

Subsequently, the determiner (43) determines whether or not the actual liquid-to-gas temperature difference ΔT is greater than the required liquid-to-gas temperature difference Δ Tmin (step ST44). The actual liquid-to-gas temperature difference Δ T is the difference between the refrigerant temperature at the inlet of the high-temperature-side portion of the liquid-gas heat exchanger (25) and the refrigerant temperature at the outlet of the low-temperature-side portion thereof. The refrigerant temperature at the inlet of the high-temperature-side portion of the liquid-gas heat exchanger (25) is measured with the first temperature sensor (31), and the refrigerant temperature at the outlet of the low-temperature-side portion thereof is measured with the second temperature sensor (32). In other words, the liquid-to-gas temperature difference ΔT is the difference between the temperature of liquid refrigerant at the inlet of the liquid-gas heat exchanger (25) and the temperature of gas refrigerant at the outlet thereof. As illustrated in FIG. 9, while, in the liquid-gas heat exchanger (25), the temperature of liquid refrigerant through the liquid-side channel (25*a*) decreases from the inlet thereof to the outlet thereof, the temperature of gas refrigerant through the gas-side channel (25*b*) increases from the inlet thereof to the outlet thereof. The difference in temperature between the liquid refrigerant through the liquid-side channel (25*a*) and the gas refrigerant through the gas-side channel (25*b*) is constant from each of the inlets to a corresponding one of the outlets.

In a case where the actual liquid-to-gas temperature difference Δ T is greater than the required liquid-to-gas temperature difference Δ Tmin, the determiner (43) selects the above-described determined temporary intermediate pressure value Pm1 as the intermediate pressure value Pm (step ST46). This case corresponds to a "case 1" illustrated in FIG. 10, and the required liquid-to-gas temperature difference Δ Tmin here is a required liquid-to-gas temperature difference Δ Tmin1. The intermediate pressure of the refrigeration cycle has been equal to the determined temporary intermediate pressure value Pm1 through the above-described step ST2. Thus, the actual liquid-to-gas temperature difference Δ T is a value obtained when the intermediate pressure of the refrigeration cycle is equal to the determined temporary intermediate pressure value Pm1 (the point J illustrated in FIG. 10). The situation where the actual liquid-to-gas temperature difference Δ T is greater than the required liquid-to-gas temperature difference Δ Tmin1 shows that the degree of superheat SH of refrigerant sucked into the compressor (21) satisfies the required degree of superheat SH, and the space heating capacity of the indoor heat exchanger (22) satisfies the required space heating capacity. For this reason, in this case, the determined temporary intermediate pressure value Pm1 is selected as the intermediate pressure value Pm without being changed. This enables the selection of the intermediate pressure which satisfies the required space heating capacity and under which the coefficient of performance of the refrigeration cycle is greatest.

In the "case 1," the actual liquid-to-gas temperature difference Δ T is greater than the required liquid-to-gas temperature difference Δ Tmin1. This shows that the space heating capacity of the indoor heat exchanger (22) is higher than required. To address this problem, if the intermediate pressure value Pm is set at a value corresponding to the required liquid-to-gas temperature difference Δ Tmin1 (a value lower than the temporary intermediate pressure value Pm1), such as the point M illustrated in FIG. 10, the required space heating capacity is satisfied while the coefficient of performance of the refrigeration cycle decreases. This causes operation to be less energy efficient. In contrast, in this embodiment, heating operation is performed with optimum energy efficiency.

In a case where the actual liquid-to-gas temperature difference Δ T is less than or equal to the required liquid-to-gas temperature difference Δ Tmin, the determiner (43) repeats changing the determined temporary intermediate pressure value Pm1 to Pm1+α until the liquid-to-gas temperature difference Δ T exceeds the required liquid-to-gas temperature difference Δ Tmin (step ST45), and selects the changed temporary intermediate pressure value Pm1 as the intermediate pressure value Pm (step ST46). This case corresponds to a "case 2" or a "case 3" illustrated in FIG. 10. Here, the required liquid-to-gas temperature difference Δ Tmin in the case 2 is a required liquid-to-gas temperature difference Δ Tmin2, and the required liquid-to-gas temperature difference Δ Tmin in the case 3 is a required liquid-to-gas temperature difference Δ Tmin3. The intermediate pressure of the refrigeration cycle has been equal to the selected temporary intermediate pressure value Pm1 through the above-described step ST2. Thus, the actual liquid-to-gas temperature difference Δ T is a value obtained when the intermediate pressure of the refrigeration cycle is equal to the selected temporary intermediate pressure value Pm1 (the point J illustrated in FIG. 10). The situation where the actual liquid-to-gas temperature difference Δ T is less than the required liquid-to-gas temperature difference Δ Tmin2 or Δ Tmin3 shows that the degree of superheat SH of refrigerant sucked into the compressor (21) does not satisfy the required degree of superheat SH, and the space heating capacity of the indoor heat exchanger (22) does not satisfy the required space heating capacity. For this reason, if, in this case, the temporary intermediate pressure value Pm1 determined by the temporary value setter (42) is selected as the intermediate pressure value Pm without being changed, the coefficient of performance of the refrigeration cycle is greatest, and the determined intermediate pressure value does not satisfy the required space heating capacity. In other words, heating operation is performed at inadequate capacity.

Figure 10:
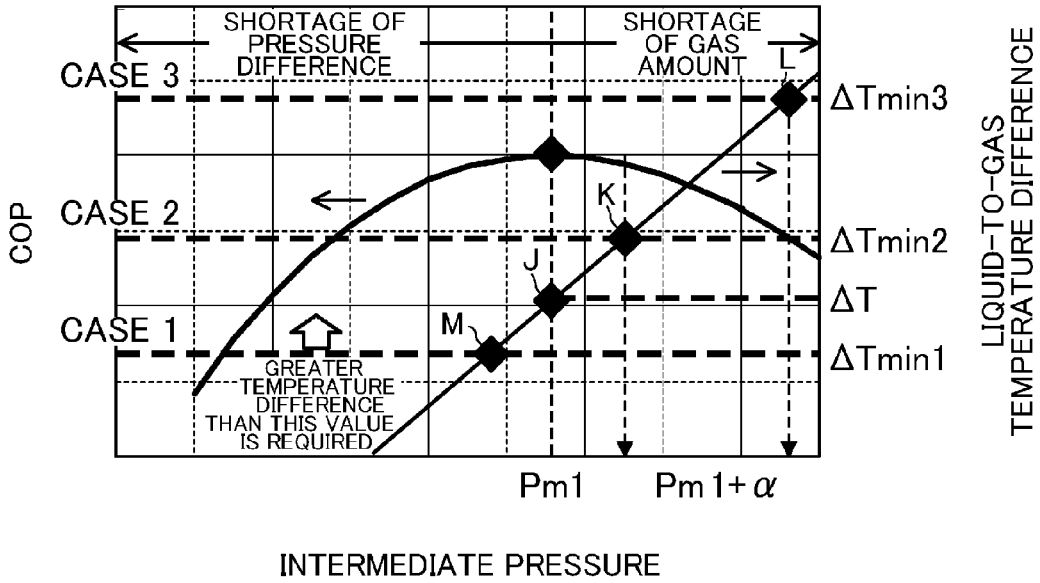
FIG. 10 is a graph for explaining the relationship among the intermediate pressure, the COP, and the liquid-to-gas temperature difference.
Figure 11A:
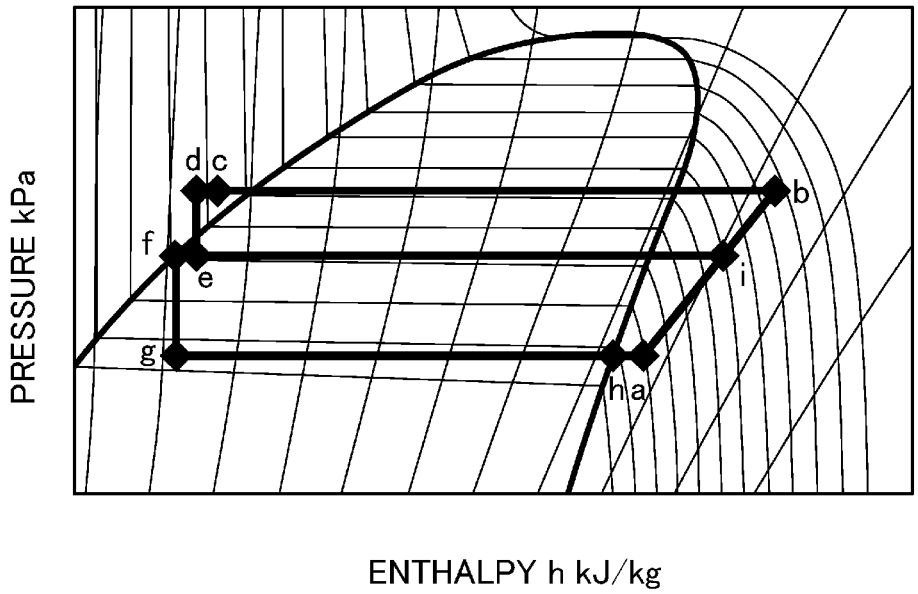
FIGS. 11A and 11B are Mollier diagrams illustrating the behavior of refrigerant in a refrigerant circuit according to a conventional air conditioning system.
Figure 11B:
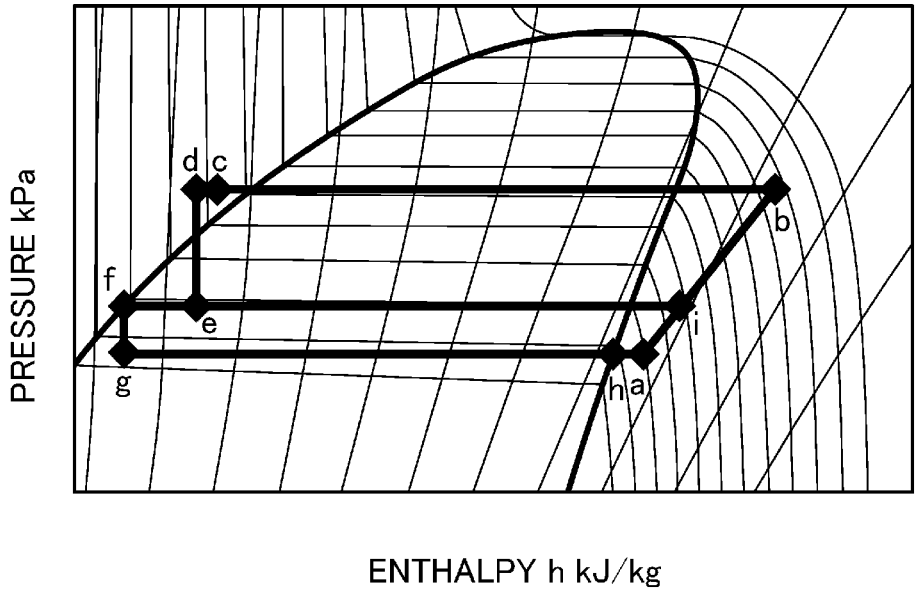

To address this problem, in this embodiment, the intermediate pressure value Pm is set at a value corresponding to the required liquid-to-gas temperature difference Δ Tmin2 or Δ Tmin3, such as the point K illustrated in FIG. 10 (in the case 2) or the point L illustrated therein (in the case 3). In other words, the intermediate pressure value Pm is set at a value greater than the temporary intermediate pressure value Pm1 determined by the temporary value setter (42) (Pm1+α). This enables the selection of the intermediate pressure under which the degree of superheat SH of refrigerant sucked into the compressor (21) satisfies the required degree of superheat SH, and under which the space heating capacity of the indoor heat exchanger (22) satisfies the required space heating capacity. When the intermediate pressure value Pm is set at a value greater than the temporary intermediate pressure value Pm1 determined by the temporary value setter (42), this setting prevents the coefficient of performance of the refrigeration cycle from being greatest, and enables the selection of the intermediate pressure under which the coefficient of performance of the refrigeration cycle is greatest within the range in which the degree of superheat SH of refrigerant sucked into the compressor (21) satisfies the required degree of superheat SH. This enables the selection of the intermediate pressure which satisfies the required space heating capacity and under which the coefficient of performance of the refrigeration cycle is optimum.

As described above, the intermediate pressure setter (41) of this embodiment determines the intermediate pressure value Pm such that the actual liquid-to-gas temperature difference Δ T is greater than or equal to the required liquid-to-gas temperature difference Δ Tmin required to allow the degree of superheat SH of refrigerant sucked into the compressor (21) to satisfy the required degree of superheat SH, and such that the gas injection amount allows the coefficient of performance of the refrigeration cycle to be optimum.

—Advantages of Embodiment—

The refrigerant circuit (20) of this embodiment includes the gas injection pipe (2*c*) and the liquid-gas heat exchanger (25). Through the gas injection pipe (2*c*), intermediate-pressure gas refrigerant in the gas-liquid separator (24) flows into a portion of the compressor (21) in which refrigerant is being compressed. The liquid-gas heat exchanger (25) exchanges heat between low-pressure gas refrigerant that is obtained by evaporating refrigerant in the outdoor heat exchanger (27) and travels toward the compressor (21) and intermediate-pressure liquid refrigerant that travels from the gas-liquid separator (24) toward the second expansion valve (26). The above configuration enables the injection of a sufficient amount of gas refrigerant into the compressor (21), and can ensure a sufficient degree of superheat SH of refrigerant sucked into the compressor (21). This can adequately increase both of the coefficient of performance (COP) of the refrigeration cycle and space heating capacity.

The intermediate pressure setter (41) of this embodiment determines the intermediate pressure value Pm such that the actual liquid-to-gas temperature difference Δ T is greater than or equal to the required liquid-to-gas temperature difference Δ Tmin required to allow the degree of superheat SH of refrigerant sucked into the compressor (21) to satisfy the required degree of superheat SH, and such that the amount of gas refrigerant injected through the gas injection pipe (2*c*) allows the coefficient of performance of the refrigeration cycle to be optimum. This enables the selection of the intermediate pressure which satisfies the required space heating capacity and under which the coefficient of performance of the refrigeration cycle is optimum. This determination enables energy efficient heating operation satisfying the required capacity.

In this embodiment, single component refrigerant containing HFO-1234yf (2,3,3,3-tetrafluoro-1-propene) is used as refrigerant. The performance of the HFO-1234yf (2,3,3,3-tetrafluoro-1-propene) decreases at low temperature. Specifically, since the density of this type of refrigerant extremely decreases at low temperature, this causes a shortage of refrigerant circulating through the refrigerant circuit (20). As a result, when the outdoor air temperature is relatively low, it is difficult to satisfy the required space heating capacity. However, according to this embodiment, the required space heating capacity can be adequately satisfied as described above.

INDUSTRIAL APPLICABILITY

As described above, the present invention is useful for refrigeration apparatuses that perform a two-stage expansion refrigeration cycle.

DESCRIPTION OF REFERENCE CHARACTERS

100 AIR CONDITIONING SYSTEM (REFRIGERATION APPARATUS)
20 REFRIGERANT CIRCUIT
21 COMPRESSOR (COMPRESSION MECHANISM)
22 INDOOR HEAT EXCHANGER (UTILIZATION-SIDE HEAT EXCHANGER)
23 FIRST EXPANSION VALVE
24 GAS-LIQUID SEPARATOR
25 LIQUID-GAS HEAT EXCHANGER
26 SECOND EXPANSION VALVE
27 OUTDOOR HEAT EXCHANGER (HEAT-SOURCE-SIDE HEAT EXCHANGER)
41 INTERMEDIATE PRESSURE SETTER
42 TEMPORARY VALUE SETTER
43 DETERMINER
45 VALVE CONTROLLER
2*c* GAS INJECTION PIPE

The invention claimed is:

1. A refrigeration apparatus comprising:
a refrigerant circuit configured to perform a two-stage expansion refrigeration cycle, the refrigerant circuit including:
a compression mechanism configured to discharge compressed refrigerant,
a utilization-side heat exchanger configured to condense the compressed refrigerant discharged by the compression mechanism, and discharge the condensed refrigerant,
a first expansion valve configured to depressurize the condensed refrigerant discharged by the utilization-side heat exchanger,
a gas-liquid separator configured to separate liquid refrigerant from gas refrigerant within the refrigerant depressurized by the first expansion valve, the gas-liquid separator including a first outlet to discharge the liquid refrigerant,
a second expansion valve configured to further depressurize the liquid refrigerant discharged from the first outlet of the gas-liquid separator, and
a heat-source-side heat exchanger configured to evaporate the liquid refrigerant further depressurized by the second expansion valve to obtain gas refrigerant,
the heat-source-side heat exchanger discharging the gas refrigerant toward a first portion of the compression mechanism, wherein
the refrigerant circuit further includes:
a gas injection pipe connecting a second outlet of the gas-liquid separator and an inlet of the compression mechanism such that the gas refrigerant flows out of the gas-liquid separator through said gas injection pipe into a second portion of the compression mechanism configured to compress refrigerant,
a liquid-gas heat exchanger configured to exchange heat between:
the gas refrigerant discharged by the heat-source-side heat exchanger and travelling toward the first portion of compression mechanism, and
the liquid refrigerant discharged by the gas-liquid separator and travelling toward the second expansion valve, and
a passage for conveying the liquid refrigerant through the liquid-gas heat exchanger, and
the first expansion valve and the second expansion valve respectively disposed upstream and downstream of the liquid-gas heat exchanger in the passage that conveys the liquid refrigerant through the liquid-gas heat exchanger.

2. The refrigeration apparatus of claim 1 further comprising:
an intermediate pressure setter configured to:
determine a required degree of superheat of refrigerant sucked into the first portion of the compression mechanism based on a required heating capacity of the utilization-side heat exchanger;
determine a required temperature difference between the liquid refrigerant and the gas refrigerant in the liquid-gas heat exchanger for achieving the required degree of superheat while maximizing an amount of the gas refrigerant flowing through the gas injection pipe;
determine an intermediate pressure value of the two-stage expansion refrigeration cycle sufficient to make an actual liquid-to-gas temperature difference between the liquid refrigerant and gas refrigerant greater than or equal to the required liquid-to-gas temperature difference; and
a valve controller configured to control at least one of the first and second expansion valves such that an intermediate pressure of the two-stage expansion refrigeration cycle is equal to the intermediate pressure value determined by the intermediate pressure setter.

3. The refrigeration apparatus of claim 2, wherein
the intermediate pressure setter includes:
a value setter configured to determine an intermediate pressure value of the two-stage expansion refrigeration cycle to maximize a coefficient of performance of the refrigeration cycle is greatest, based on the required degree of superheat of the refrigerant; and
a determiner configured to:
obtain information of respective temperatures of the gas refrigerant at an inlet and an outlet of the liquid-gas heat exchanger, the respective temperatures being measured subsequent to the determination of the intermediate pressure value by the temporary value setter, the respective temperatures being measured when a degree of superheat of the refrigerant sucked into the first portion of the compression mechanism reaches the required degree of superheat, calculate a required amount of heat to be exchanged between liquid refrigerant and gas refrigerant in the liquid-gas heat exchanger based on the received information of the respective temperatures, calculate the required liquid-to-gas temperature difference based on the required amount of heat to be exchanged, select the intermediate pressure value determined by the temporary value setter as the intermediate pressure of the two-stage expansion refrigeration cycle in a situation where the actual liquid-to-gas temperature difference between the liquid refrigerant and the gas refrigerant in the liquid-gas heat exchanger is greater than the required liquid-to-gas temperature difference, and select a value greater than the intermediate pressure value as the intermediate pressure of the two-stage expansion refrigeration cycle in a situation where the actual liquid-to-gas temperature difference is less than or equal to the required liquid-to-gas temperature difference, when the value setter determines the intermediate pressure value, the valve controller controls at least one of the first and second expansion valves such that the intermediate pressure of the two-stage expansion refrigeration cycle is equal to the determined intermediate pressure value, and when the determiner determines the intermediate pressure value, the valve controller controls at least one of the first and second expansion valves such that the intermediate pressure of the two-stage expansion refrigeration cycle is equal to the determined intermediate pressure value.

* * * * *